US007988275B2

(12) United States Patent
Komatsu et al.

(10) Patent No.: US 7,988,275 B2
(45) Date of Patent: Aug. 2, 2011

(54) INKJET HEAD

(75) Inventors: Katsuaki Komatsu, Tokyo (JP); Masahiro Makita, Tokyo (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 912 days.

(21) Appl. No.: 11/877,119

(22) Filed: Oct. 23, 2007

(65) Prior Publication Data

US 2008/0100683 A1 May 1, 2008

(30) Foreign Application Priority Data

Oct. 27, 2006 (JP) ..... 2006-292351
Nov. 25, 2006 (JP) ..... 2006-317874
Mar. 30, 2007 (JP) ..... 2007-091432

(51) Int. Cl.
*B41J 2/19* (2006.01)
*B41J 2/17* (2006.01)
*B41J 2/175* (2006.01)

(52) U.S. Cl. ..... 347/92; 347/84; 347/85; 347/86; 347/87

(58) Field of Classification Search ..... 347/20, 347/42, 44, 47, 54–56, 65–66, 68, 71, 84–87, 347/90–92
See application file for complete search history.

(56) References Cited

U.S. PATENT DOCUMENTS 6,120,139 A * 9/2000 Childers et al. ..... 347/92
6,378,994 B1 * 4/2002 Ueda et al. ..... 347/65
6,578,954 B2 * 6/2003 Okuda et al. ..... 347/70
6,880,910 B2 * 4/2005 Tominaga ..... 347/20
7,128,406 B2 * 10/2006 Dixon et al. ..... 347/85
7,252,370 B2 * 8/2007 Hirota ..... 347/68
2003/0234845 A1 * 12/2003 Tominaga et al. ..... 347/92
2004/0017439 A1 * 1/2004 Tominaga et al. ..... 347/65
2004/0027427 A1 * 2/2004 Tominaga ..... 347/85
2005/0036005 A1 * 2/2005 Chikamoto ..... 347/65
2005/0157104 A1 * 7/2005 Hirota et al. ..... 347/85
2006/0132551 A1 6/2006 Chikamoto
2006/0262172 A1 * 11/2006 Kaga ..... 347/86

FOREIGN PATENT DOCUMENTS

EP 1541362 6/2005
EP 1658978 5/2006
JP 07186381 A * 7/1995
JP 2002361864 A * 12/2002
JP 2005138301 A * 6/2005

OTHER PUBLICATIONS

Machine Translation for JP 2005138301 A.*

* cited by examiner

*Primary Examiner* — Stephen D Meier
*Assistant Examiner* — Leonard S Liang
(74) *Attorney, Agent, or Firm* — Lucas & Mercanti, LLP

(57) ABSTRACT

An inkjet head, comprises an ink jetting chamber unit in which a plurality of ink jetting chambers to jet ink from respective nozzles is arranged along at least one array; a manifold to distribute ink to the plurality of ink jetting chambers; a first ink flow path to supply ink from the outside to the manifold; an air chamber structured to form an air-liquid interface at which air contacts with ink in the air chamber; and a second ink flow path branched from the first ink flow path and connected to the air chamber.

24 Claims, 12 Drawing Sheets

INKJET HEAD

This application is based on Japanese Patent Application No. 2006-292351 filed on Oct. 27, 2006, Japanese Patent Application No. 2006-317874 filed on Nov. 25, 2006, and Japanese Patent Application No. 2007-091432 filed on Mar. 30, 2007, in Japanese Patent Office, the entire content of which is hereby incorporated by reference.

BACKGROUND OF THE INVENTION

The present invention relates to an inkjet head. Conventionally, an inkjet printer which jets the ink onto the recording medium such as a sheet or plastic thin plate and records a predetermined image is proposed and in practical use. The inkjet printer has an inkjet head having a nozzle, when the ink is jetted to the recording medium from the nozzle while such an inkjet heads is moved in a predetermined direction, a predetermined image is recorded on the recording medium.

Hereupon, there is a case where the ink used for the inkjet printer is supplied to the head on a carriage from an ink supply vessel through an ink supply tube.

In this ink supply mechanism, in order to scan the carriage on which the head is mounted, an ink pressure supplied to the head is varied by the acceleration and deceleration or vibration. In this case, there is a problem that when the meniscus position of the nozzle of the head is dislocated, uneven density is caused and in the worst case, the meniscus is broken and the ink can not be jetted.

Further, in the conventional proposal for the resolution for such a phenomenon, there is a proposal by which the pressure variation at the time of ink supply is absorbed as a structure in which a damper is arranged on the upstream of the head as shown in Patent Document 1 (Tokkai 2000 No. 158868), Patent Document 6 (Tokkaihei 10 No. 193646), Patent Document 7 (Tokkaihei 11 2000 No. 34349). However, when there is piping between the damper and head, there is a problem that although it is minute, the variation is caused in the ink supply pressure by the mechanical vibration or acceleration and deceleration.

Therefore, conventionally, in order to prevent such a minute pressure variation, there is a structure in which the damper function is provided in the inside of the head.

For example, in Patent Document 2 (Tokkai 2001 No. 130004), a structure in which a shield structure air chamber is provided in the common ink chamber of the head and the damper function is given is disclosed. Further, in Patent Document 3 (Tokkai 2004 No. 114415), a structure in which the damper function is given by using a thin plate in the lamination head is disclosed. Further, in Patent Document 4 (Tokkaihei 7 No. 137262), a structure in which a groove is formed in the common ink chamber of the head, and separated from the air chamber by the film and the damper function is given is disclosed. In Patent Document 5 (Tokkaihei 7 No. 323548), a structure in which a gas holding chamber is formed adjoining the common ink chamber of the head and the bubble is accumulated by the electrolyzation and the damper function is provided is disclosed. In Patent Document 8 (Tokkai 2004 No. 226321), a head for bio-chip by which when the ink of the reservoir of the head is brought into contacted with the air, the down-sized pressure chamber can be structured, is disclosed.

As disclosed in the above Patent Documents 2, 3, 4, when a member such as the film is stood on the interface between the air chamber and the ink, the wash out of the air from the air chamber can be securely prevented. However, for forming such structure, because the new part or manufacturing process is necessary, further, the structure becomes complicated, a special design is necessary and there is a possibility that results in the cost-up or the reliability decrease.

Further, as disclosed in the above Patent Documents 5, 8, in a structure in which the air-liquid interface is formed by contacting the air with the ink, it is not simple that the air is stably accumulated in such a position, and a problem that the air-liquid interface does not exist by the suction movement for preventing the blinding of the nozzle, is generated.

Particularly, when the air is introduced into the common, ink chamber, because the air is not fixed in the common ink chamber, and can be freely moved, it enters into the pressure chamber, the accident that it often prevents the jetting of the ink is happened, or a problem that the air which is entered at a great pain is delivered, is generated.

Further, in the above structure in which the air-liquid inter face is formed by contacting the air with the ink, because in the air-liquid interface in which the air contacts with the ink, the air is dissolved in the ink. When a predetermined time passes, the air is diminished, there is a problem that the absorption effect of the pressure variation is loosed. The velocity in which the air dissolves is very slow, there also be a case where it takes a several months. It is not preferable because it results in the cost-up that the mechanism by which the air is newly supplied at such a span, is provided.

In any Patent Documents, there is no description relating to that the air is dissolved in the ink, and there is no disclose relating also to influence that it gives to the absorption effect of the pressure variation.

Further, as disclosed in the above Patent Document 5, in the structure that the air holding chamber is formed adjoining the common ink chamber of the head and that bubble is accumulated by the electrolysis and the air is supplied, the structure becomes complicated, and the complicate control of the timing that the bubble is generated by the electrolysis, is necessary. Further, there is also a problem that it does not function in the oil-based ink in which the gas is not generated by the electrolysis.

Further, in a structure in which the gas holding chamber is formed adjoining the common ink chamber of the head and the bubble is accumulated by the electrolysis and the air is supplemented as disclosed in the above Patent Document 5, the structure becomes complicate and the complicate control such as the timing at which the bubble is generated by the electrolysis becomes necessary. Further, there also is a problem that it does not function in the oil-based ink in which the gas is not generated by the electrolysis.

SUMMARY OF THE INVENTION

The object of the present invention is to provide an inkjet head by which the above-described problem is intended to solve, by the air chamber, the variation of the ink supply pressure is absorbed, and the jetting stability can be maintained, and the wash-out of the air from the air chamber can be prevented by a simple structure.

The above object can be attained by the inkjet head having the following structure.

An inkjet head, comprises:

an ink jetting chamber unit in which a plurality of ink jetting chambers to jet ink from respective nozzles is arranged along at least one array;

a manifold to distribute ink to the plurality of ink jetting chambers;

a first ink flow path to supply ink from the outside to the manifold;

an air chamber structured to form an air-liquid interface at which air contacts with ink in the air chamber; and a second ink flow path branched from the first ink flow path and connected to the air chamber.

BRIEF DESCRIPTION OF THE DRAWINGS

FIG. 8(*b*) is a sectional view of the air chamber forming member of FIG. 8(*a*) showing a condition in which the air chamber forming member and the manifold are fitted to a head chip 41.

FIG. 9(*b*) is a sectional view of the air chamber forming member of FIG. 9(*a*) showing a condition in which the air chamber forming member and the manifold are fitted to a head chip 41.

FIG. 10(*b*) is a sectional view of the air chamber forming member of FIG. 10(*a*) showing a condition in which the air chamber forming member and the manifold are fitted to a head chip 41.

DETAILED DESCRIPTION OF THE PREFERRED EMBODIMENT

Figure 1:
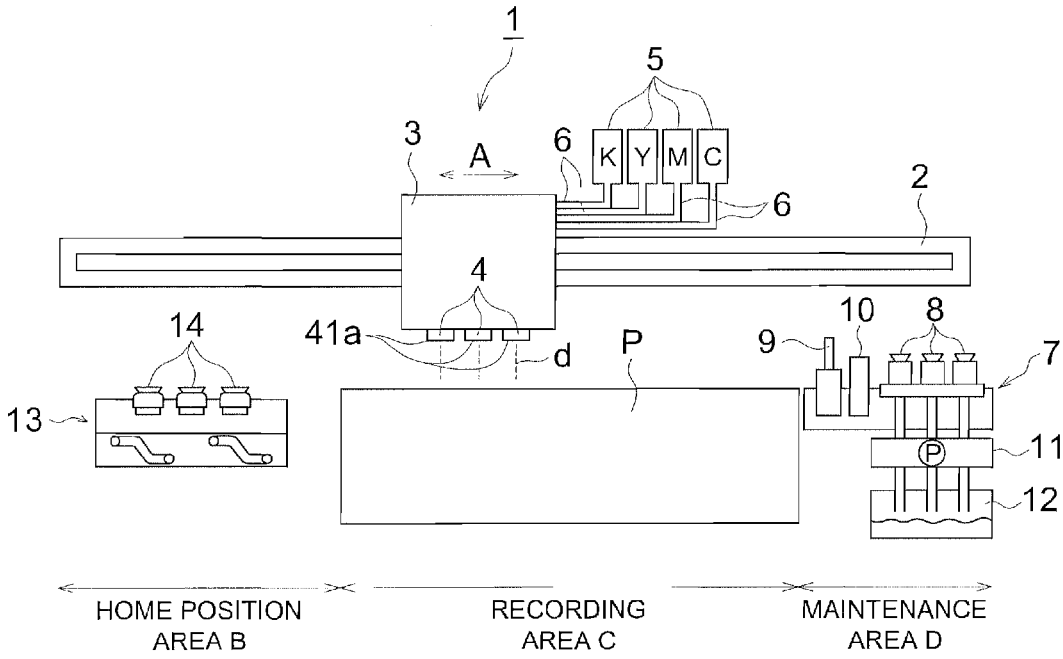
FIG. 1 is a plain view of an inkjet printer according to an embodiment of the present invention.

Hereinafter, preferable embodiments of the present invention are explained. However, the present invention is not limited to these embodiments.

Firstly, preferable structures of the inkjet head of the present invention are explained.

1-1. In an inkjet head provided with an inkjet head chip having nozzle array; a manifold to introduce ink to the inkjet head chip; and a first ink flow path to lead ink from the outside to the manifold; the inkjet head is characterized to be provided with an air chamber and a second ink flow path branched from the middle of the first ink flow path and connected to the air chamber.

1-2. In the inkjet head described in 1-1, the inkjet head is characterized in that the manifold is provided at one side of the inkjet head chip and the air tank is provided at the other side of the inkjet head chip.

1-3. In the inkjet head described in 1-2, the inkjet head is characterized in that the side wall of the inkjet head chip forms a part of the side wall of the air chamber.

1-4. In the inkjet head described in 1-1, the inkjet head is characterized in that the manifold is provided at both sides of the inkjet head chip and the air chamber is provided at the side of the manifold.

1-5. In the inkjet head described in any one of 1-1 to 1-4, the inkjet head is characterized in that the first ink flow path is provided with an ink supply chamber and the second flow path is branched from the ink supply chamber.

1-6. In the in-inkjet head described in any one of 1-1 to 1-5, the inkjet head is characterized in that a connection part of the second ink flow path and the air chamber is formed on a position closer to a nozzle side than an ink inlet side of the inkjet head chip on a wall surface forming the air chamber.

1-7. In the inkjet head described in any one of 1-1 to 1-6, the inkjet head is characterized in that the flow resistance of the second ink flow path is smaller than that of the first ink flow path located between the manifold and the branch section of the second flow path.

According to the present invention, the inkjet head by which because the second ink flow path which branches from the midway of the first ink flow path by which the ink from the outside is guided to the manifold, and is connected to the air chamber is provided, when the air liquid interface is formed in the air chamber, because the air is held, the pressure variation of the ink transmitted to the manifold at the time of ink-jetting can be absorbed in the air and the air can be stably held in the air chamber at the time of the maintenance motion by the ink suction motion from the nozzle, the variation of the ink supply pressure is absorbed by the air chamber, and the jet stability can be maintained, and the wash out of the air from the air chamber, can be effectively prevented by a simple structure, can be provided.

2-1. In an inkjet head provided with an inkjet head chip having nozzle array; a manifold to introduce ink to the inkjet head chip; and a first ink flow path to lead ink from the outside to the manifold; the inkjet head is characterized in that there are provided with an air chamber and a second ink flow path branched from the middle of the first ink flow path and connected to the air chamber and a, part of a member forming the air chamber and coming in contact with are kept in the air chamber has a breathability.

2-2. In the inkjet head described in 2-1, the inkjet head is characterized in that the manifold is provided at one side of the inkjet head chip and the air tank is provided at the other side of the inkjet head chip.

2-3. In the inkjet head described in 2-2, the inkjet head is characterized in that the side wall of the inkjet head chip forms a part of the side wall of the air chamber.

2-4. In the inkjet head described in 2-1, the inkjet head is characterized in that the manifold is provided at both sides of the inkjet head chip and the air chamber is provided at the side of the manifold.

2-5. In the inkjet head described in any one of 2-1 to 2-4, the inkjet head is characterized in that the first ink flow path is provided with an ink supply chamber and the second flow path is branched from the ink supply chamber.

2-6. In the inkjet head described in any one of 2-1 to 2-5, the inkjet head is characterized in that a connection part of the second ink flow path and the air chamber is formed on a position closer to a nozzle side than an ink inlet side of the inkjet head chip on a wall surface forming the air chamber.

2-7. In the inkjet head described in any one of 2-1 to 2-6, the inkjet head is characterized in that the flow resistance of the second ink flow path is smaller than that of the first ink flow path located between the manifold and the branch section of the second flow path.

2-8. In the inkjet head described in any one of 2-1 to 2-7, the inkjet head is characterized in that the member having a breathability is a film having a breathability.

2-9. In the inkjet head described in any one of 2-1 to 2-7, the inkjet head is characterized in that the member having a breathability is an adhesive having a breathability and sealing a mesh-like opening provided to the member forming the air chamber.

2-10. In the inkjet head described in any one of 2-1 to 2-7, the inkjet head is characterized in that the member having a breathability is a tube having a breathability and attached to an opening provided to the member forming the air chamber.

2-11. In the inkjet head described in any one of 2-1 to 2-10, the inkjet head is characterized in that the outside of the member having a breathability comes in contact with atmosphere.

Further, because at least one part of the member for4ming the air chamber, which contacts with the air choked in the air chamber, has the air permeability, in the air liquid interface in which the air contacts with the ink, the decrease of the air by which the air dissolves in the ink, can be supplemented by the air supplied to the air chamber transmitted through the member having the air permeability, and the inkjet head by which the absorption effect of the pressure variation can be maintained for a long period of time by a simple structure, can be provided.

3-1. An inkjet head is characterized to be provided with an inkjet head chip having a nozzle to jet an ink and a pressure chamber communicated with the nozzle; and ink supply path to supply ink from the outside to the inkjet head chip; and an air damper chamber branched from the ink supply path and having a labyrinth structure.

3-2. The inkjet head described in 3-1 is characterized in that the ink supply path includes an ink supply chamber and the air damper chamber of the labyrinth structure is branched from the ink supply chamber.

3-3. The inkjet head described in 3-1 or 3-2 is characterized in that at least a part of an inner wall of the air damper chamber of the labyrinth structure is formed by a partition wall arranged to form the labyrinth structure.

3-4. The inkjet head described in any one of 3-1 to 3-3 is characterized in that the labyrinth structure is a zigzag structure.

3-5. The inkjet head described in 3-4 is characterized in that in the air damper chamber, the zigzag structure is formed from the communication side with the ink supply path to the other end side.

3-6. The inkjet head described in 3-4 or 3-5 is characterized in that the air damper chamber of the labyrinth structure is arranged such that a plane including the zigzag structure is not in parallel to the horizontal plane.

3-7. The inkjet head described in any one old 3-1 to 3-6 is characterized in that a partial surface of the inkjet head chip forms a part of the inner wall of the air damper chamber.

3-8. The inkjet head described in any one of 3-1 to 3-7 is characterized in that there is provided an air injecting mechanism at the other end side different from the communication side with the ink supply path in the air damper chamber of the labyrinth structure.

Referring to the drawings, an embodiment of the present invention will be described below.

Initially, referring to FIG. 1, the overall structure of the inkjet printer of an embodiment of the present invention will be described. FIG. 1 is an overall structure of the inkjet printer of an embodiment of the present invention.

The inkjet printer 1 is a printer which jets the ink onto a recording medium P and records an image on the recording medium P. A conveying means, not shown, is provided in the inkjet printer, and this conveying means conveys the recording medium P in the sub scanning direction orthogonal to the main scanning direction A while passing it through a recording area C in FIG. 1.

Above the recording area C, a carriage rail 2 extending along the main scanning direction, is arranged, and on the carriage rail 2, a carriage 3 guided by the carriage rail 2, is movably provided.

The carriage 3 mounts the inkjet head 4 which jets the ink to the recording medium P, and moves in the arrow mark A direction along the carriage rail 2 from the home position area B to the maintenance area D.

When during this main scanning, the inkjet head 4 jets the ink d to the recording medium P, the image is formed on the recording medium P. The inkjet head 4 is perpendicularly arranged so that the ink jetting direction from the nozzle is to perpendicularly downward.

In the inkjet printer 1 according to the present embodiment, total four (4) inkjet heads 4 are arranged in the carriage 3, so that four (4) color ink of black (k), yellow (y), magenta (M), cyan (C) can be jetted. In FIG. 1. three (3) inkjet heads 4, 4, 4 are arranged in one row in the arrow mark A direction, and the other one inkjet head 4(not shown) is arranged in the depth side (depth side in the direction perpendicular to the sheet) of the central inkjet head 4 of the inkjet heads 4,4,4 aligned in this arrow mark A direction.

To each of these inkjet heads 4, ink tanks 5 in which each color ink of black, yellow, magenta, cyan is stored, are connected through respective ink supply tube 6. That is, the ink in the ink tank 5 is supplied to each inkjet head 4 by the ink supply tube 6.

In the maintenance area D, a maintenance unit 7 which conducts the maintenance on the inkjet head 4, is provided. In this maintenance unit 7, a plurality of suction caps 8 for sucking the ink in the nozzle, covering the jetting surface 41*a* of the inkjet head 4, and a cleaning blade 9 for cleaning adhered ink to the jetting surface 41*a*, and an ink receiver 10 for receiving the idly jetted ink from the inkjet head 4, a suction pump 11, and a wasted ink tank 12 are provided.

The suction cap 8 is communicated to the wasted ink tank 12 through the suction pump 11, and is elevated at the time of maintenance operation and covers the jetting surface 41*a* of the inkjet head 4. Four (4) suction caps 8, 8, . . . are aligned corresponding to each inkjet head 4 so that when they are elevated as described above, they can cover the jetting surfaces 41*a* of all inkjet heads 4.

The suction pump 11 is structured having a cylinder pump or a tube pump, and when the suction cap 8 operates under the condition that it covers the jetting surface 41*a*, the suction force for sucking the ink inside the inkjet head 4 from the nozzle 42 (which will be described later) with a foreign matter is generated.

Figure 5:
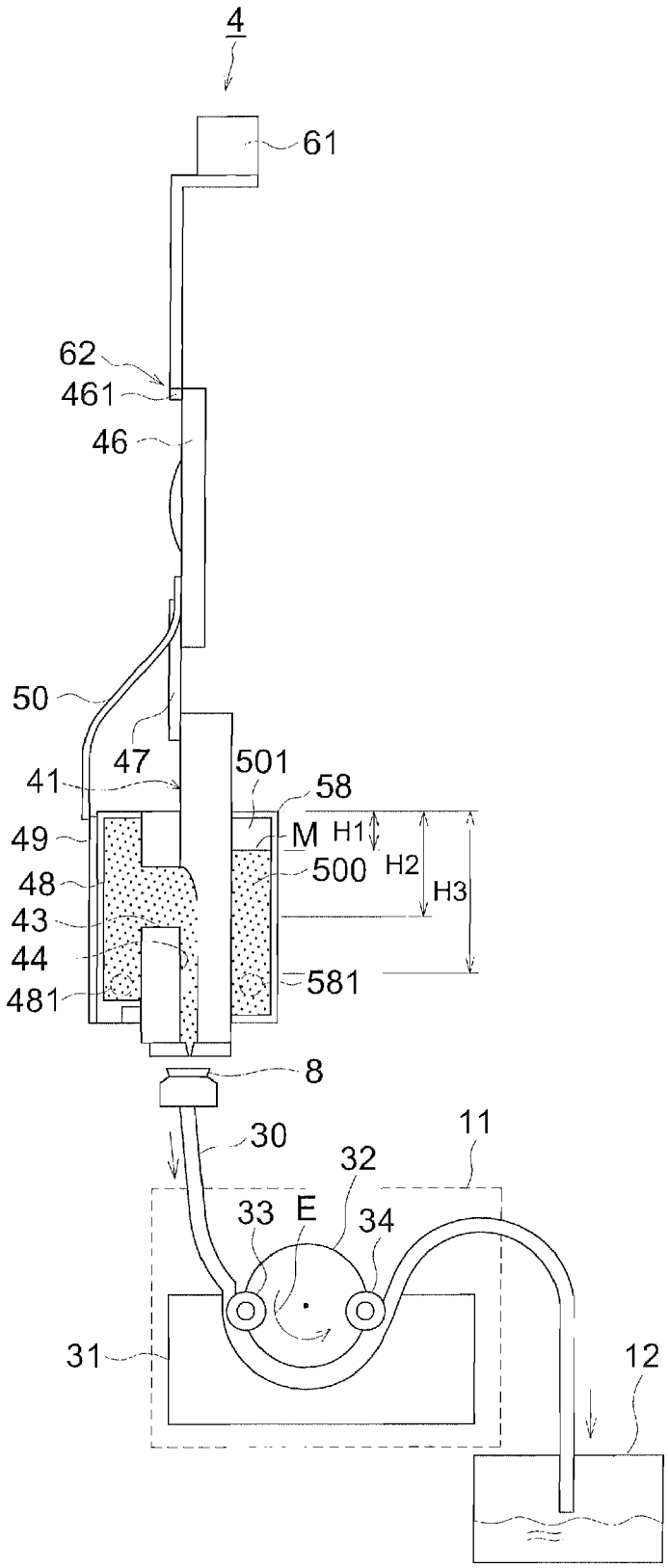
FIG. 5 is a typical view for explaining a moving mode of an ink and an air in a maintenance process by a suction of the inkjet head according to an embodiment of the present invention.

In the present embodiment, the tube type pump shown in FIG. 5 is used as the suction pump 11. The suction pump 11 as shown in FIG. 5 has a tube 30, pressure drive roller 32, two (2) pressure rollers 33, 34, and a tube holder 31. The opening on the suction side of the upper end of the tube 30 is connected to the suction cap 8. The opening on the delivery side of the lower end of the tube 30 is inserted into the waste ink tank 12. The middle part of the tube 30 is in the manner that it is sandwiched between the tube holder 31 and the pressure roller 32, and corrected in the form that it is curved into the arc shape, and held.

Two (2) pressure rollers 33, 34 are fitted to the outer periphery of the pressure drive roller 32. Two (2) pressure rollers 33, 34 protrude in the radial direction of the pressure roller 32 from the outer peripheral surface of the pressure roller 32 and fitted rotatably. Two (2) pressure rollers 33, 34 are fitted at a position respectively forming 180° around the central axis of the pressure drive roller 32. On the one hand, the tube holder 31 is formed so that it corrects the tube 30 along an angle larger than 180° around the central axis of the pressure roller drive 32, for example, along the angle range of about 210° . The above-mentioned angle is an example, and it is effective for exerting the suction force that a period to crush simultaneously the tube 30 by two (2) pressure rollers 33, 34, is provided. Further, more than three (3) the pressure rollers may be provided. In the case where more than three (3) the pressure rollers are provided, it is effective for exerting the suction force that it is structured so that two (2) pressure rollers of them always simultaneously crush the tube during rotation of the pressure drive roller 32.

Hereupon, two (2) pressure rollers 33, 34 conduct the orbital motion following the rotation of the pressure drive roller 32. Two (2) pressure rollers 33, 34 moves while crushing the tube 30 when they pass a part which is in tube holder 31. The tube 30 recovers to the original shape by its elasticity, after the pressure rollers 33, 34 have passed.

The pressure drive roller 32 is driven by the motor, not shown, and rotates around its central axis. That is, the pressure drive roller 32 rotates on its axis, and the distance to the tube holder 31 is constant during its rotation.

In order to exert the suction force, when the pressure roller 32 is rotated in the arrow mark E direction, the pressure rollers 33, 34, are orbitally-moved in the same manner in the arrow mark E direction, and a position at which the pressure rollers 33, 34 crush the tube 30, is moved. In the present embodiment, when the number of rotation of the pressure drive roller 32 is adjusted, the output of the suction pump 11 is controlled.

In the home position area B, a moisture retention unit 13 for making moisture retention the inkjet head 4, is provided. In the moisture retention unit 13, in the case where the inkjet head 14 is in stand-by condition, when covering the jetting surface 41*a*, four (4) moisture retention caps 14 which conduct the moisture retention on the ink of the inkjet head 4 are provided. These four (4) moisture retention caps 14, 14, . . . are aligned corresponding to the alignment of the inkjet head 4 so that they can simultaneously cover the jetting surface 41*a* of four (4) inkjet heads 4.

The control part is structured having CPU (central processing unit) and memory and controls each component of the inkjet printer 1. In the memory, the data of the image formed on the recording medium P, or programs for controlling each component of the inkjet printer are stored, and the control signal is transmitted to each component based on the image data or programs in this memory.

Next, referring to FIGS. 2-4, the inkjet head 4 according to the present invention will be described.

Figure 2:
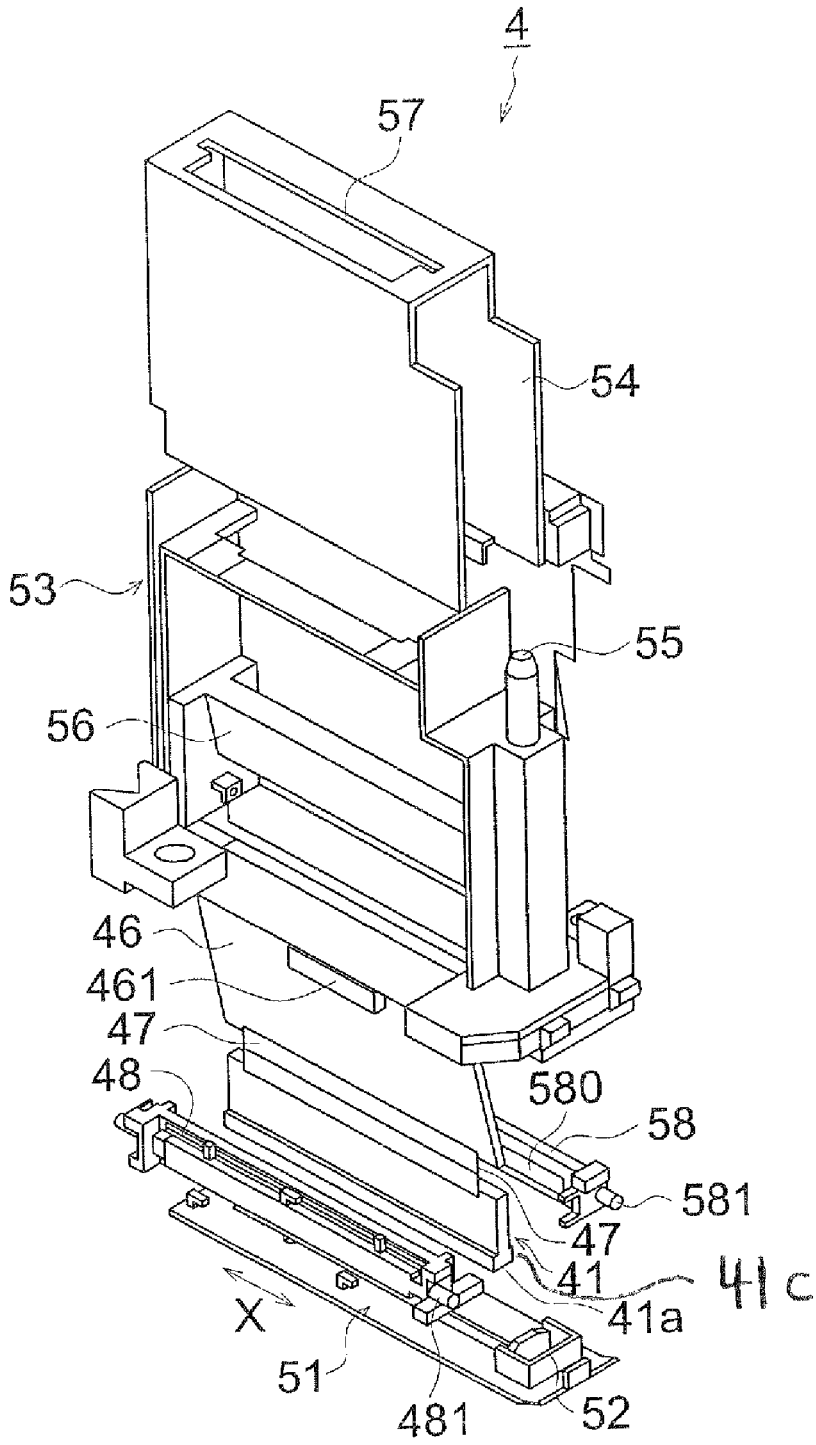
FIG. 2 is an exploded perspective view of an inkjet head according to an embodiment of the present invention.
Figure 3:
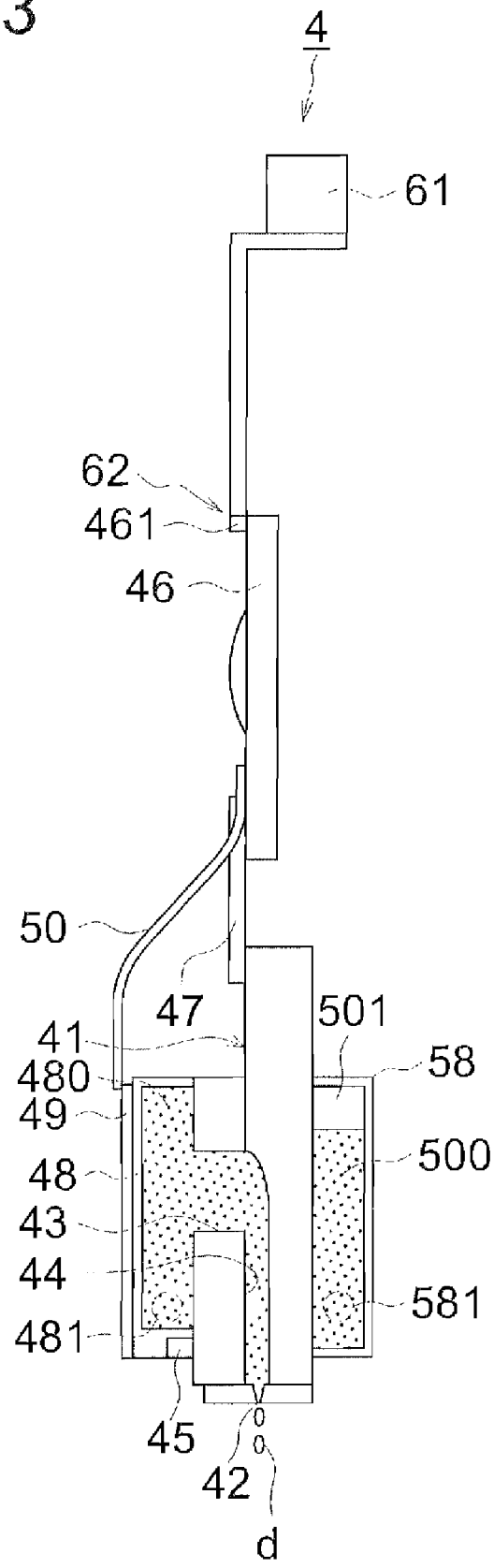
FIG. 3 is a side view of the inkjet head according to an embodiment of the present invention.

FIG. 2 is an exploded perspective view of the inkjet head 4 of the present embodiment, FIG. 3 is a side view of the inkjet head 4 of the present embodiment. Further, FIG. 4 is a typical view showing the connection condition of the air chamber of the inkjet head 4 and the manifold and the ink supply chamber of the present embodiment.

In the inkjet head 4 of the present embodiment, an inkjet head chip (hereinafter, called "head chip") 41 which an ink jetting chamber unit in which a plurality of ink jetting chambers to jet ink is arranged along at least one line. The head chip 41 has a long plate shape in arrow mark X direction, and on its jetting surface (tip surface) 41*a*, many nozzles 42 are aligned in arrow mark X direction. The row of nozzles 42 continuously provided in arrow mark X direction, is called a nozzle row 42*a*. In the inkjet head 4 of the present embodiment, a row of nozzle row 42*a* is provided. The inkjet head 4 is mounted in the carriage 3 so that arrow mark X direction (nozzle row direction) and the main scanning direction A shown in FIG. 1 are orthogonal.

As shown in FIG. 3, on one side surface of the head chip 41, a plurality of ink supply openings 43 are provided, and through a plurality of ink jetting chambers 44 formed inside the head chip 41, the ink supply openings 43 and the nozzles 42 are communicated. A part of each of the ink jetting chambers 44 forms a pressure chamber, and the pressure is varied by the action of the piezo-electric element, not shown, and structured so that the ink drop is jetted from the nozzle 42.

In this manner, in the head chip 41 (the ink jetting chamber unit), a plurality of nozzles 42 and a plurality of ink jetting chambers 44 provided corresponding to the plurality of nozzles 42 are provided being aligned in arrow mark x direction In the present invention, in the head chip 41, the surface extending along the aligning direction of the ink jetting chambers 44 is called the side surface. Further, also for the side surface of the manifold 48 which will be described later, it is defined in the same manner.

To one side part of the head chip 41, one manifold 48 which is connected to the plurality of ink supply openings 43 and guides the ink from the outside to the head chip 41 is adhered and fixed The manifold 48 is formed of the material excellent for the ink-proof and a concave for forming the common ink chamber 480 is formed. In one end part of the manifold 48, the first ink flow path 481 which flows the ink to the common ink chamber 480 is integrally provided.

Further, to the side part of the manifold 48 between the manifold and a casing frame 53 outside of the manifold, as shown in FIG. 3, an ink heater 49 is provided so that it is brought into contact with the manifold 48. This ink heater 49 is provided for heating the ink which is guided to the common ink chamber 480 of the manifold 48, to a predetermined temperature.

Further, between the manifold 48 and the casing frame 53, the adhesive agent is filled so that at least it involves the ink heater 49, hereby, the casing frame 53, ink heater 49 and manifold 48 are adhered and fixed.

In order to stabilize the ink pressure applied to such a common ink chamber 480, an air chamber forming member 58 is arranged on the opposite side to the manifold 48 with the head chip between them. The air chamber forming member 53 is formed of the material excellent for the ink-proof, and the concave is formed for forming the air chamber 580. On one end part of the air chamber forming member 58, the second ink flow path 581, for flowing the ink to the air chamber 580, is integrally provided.

Further, as shown in FIG. 2, to the lower part of the head chip 41, a holding plate 51 for holding the manifold 48, air chamber forming member 58, and head chip 41, is fitted so that the jetting surface 41*a* is exposed. On this one end part of this holding plate 51, the ink supply chamber 52 which flows the ink to the first ink flow path 481 and the second ink flow path 581, holding the first ink flow path 481 of the manifold 48 and the second ink flow path 581 of the air chamber forming member 58, is formed. The ink supply chamber 52 is arranged on one end side of the nozzle row direction of the head chip 41, and is connected to the first ink flow path 481 and, the second ink flow path 581. As shown in FIG. 4, the connection part of the second ink flow path 581 and the air chamber 580, is formed on the closer position to the nozzle 42 side than the ink inlet side of the head chip 41 in the wall surface for forming the air chamber 580.

The ink from the ink supply tube 6, enters from the ink supply path 55 to the ink supply chamber 52, and branches to the first ink flow path 481 which connects the ink supply chamber 52 and the manifold 48, and the second ink flow path 581 which connects the ink supply chamber 52 and the air chamber 580. The ink passed the first ink flow path 481, is supplied from the ink supply opening 43 to the plurality of ink jetting chambers 44 through the common ink chamber 480. The ink passed the second ink flow path 581, is supplied to the air chamber 580. When the ink 500 is filled from the ink supply path 55, the air 501 is sealed in the air chamber 580. In the embodiment, as shown in FIG. 4, when the nozzle 42 is lower side, the ink 500 is filled to a predetermined height of the air chamber 580, and in its upper part, the air 501 is shut up.

In the present embodiment, a first ink flow path as a broader definition is structured by the ink supply path 55, ink supply chamber 52 and the first ink flow path 481 which connects the ink supply chamber 52 and manifold. 48. Hereupon, the ink supply chamber 52 which is an ink pool, may also be structured without providing.

The air chamber 580 is branched from the first ink flow path 481 which guides the ink from the outside to the manifold 48, the flow out of the air 501 from the air chamber 580 to the manifold 48, is suppressed.

Figure 4:
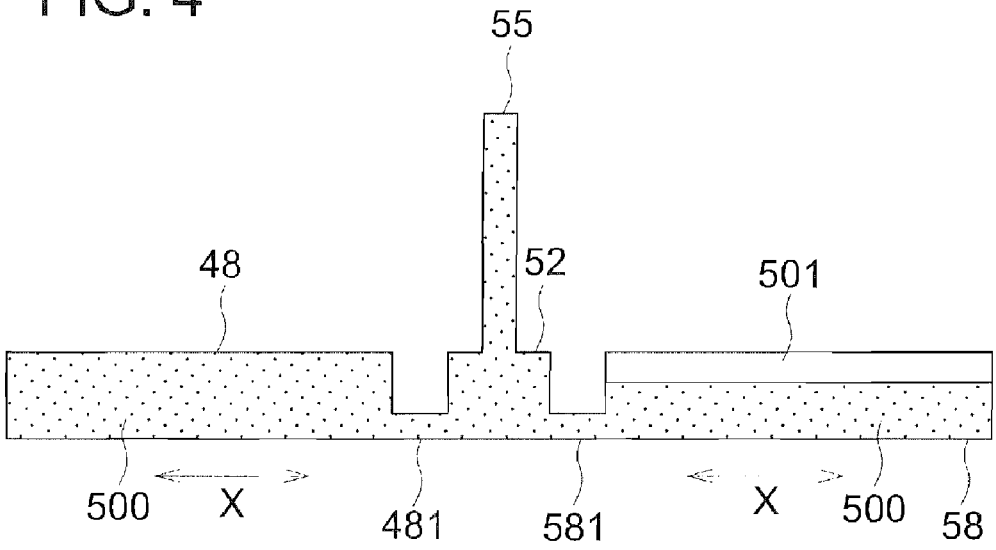
FIG. 4 is a typical view showing a connection condition of an air chambers manifold with an ink supply chamber.

Further, as shown in FIG. 4, in the case where the connection part of the second ink flow path 581 and the air chamber 580, in the wall surface for forming the air chamber 580, is formed on the position closer to the nozzle 42 side than the ink inlet side of the head chip 41, when the ink jetting direction is positioned so that it directs to the vertical lower direction, the air 501 can be easily held in the upper part of the air chamber 580, particularly, it is preferable because the air 501 is easily maintained in the upper part of the air chamber 586 at the time of sucking-in of the ink from the nozzle in the maintenance process.

The pressure change of the ink generated when the inkjet head is moved, is transmitted from the second ink flow path 581 of the air chamber forming member 58 to the air chamber 580, and absorbed by the volume change of the air chamber 501 and suppressed to so small change as the ink pressure in the common ink chamber 480 of the manifold 48 does not influence on the jetting characteristic of the ink. In order to more enhance the performance of such a pressure absorption, it is preferable that the resistance of the second ink flow path 581 which connects the ink supply chamber 52 and the air chamber 48, is smaller than the resistance of the first ink flow path 481 which connects the ink supply chamber 52 and the manifold 48. In order to decrease the resistance of the flow path, it may be allowable when the cross area of the flow path is increased.

Further, in the present embodiment, in the structure in which the manifold 48 is provided to one side part of the head chip 41, because the air chamber 580 is provided to another side part of the head chip 41, the side surface of the head chip 41 forms a part of the wall surface forming the air chamber 580, the downsizing of the inkjet head becomes possible, and the liquid (ink 500) of the air chamber 580 can absorb the vibration of the piezo-electric element of the head chip 41 at the time of the ink jetting, the transmission of the vibration to the outside can be suppressed, it is preferable embodiment.

Then, the head drive substrate 46 which transmits the control signal from the control part to each piezoelectric element, not shown, of the head chip 41, is connected through a flexible wiring plate 47. In this head drive substrate 46, a heater circuit which conducts the power supply on the ink heater 49, is formed, and to this heater circuit, the electric heating wire of the ink heater 49 is electrically connected through the electric wire 50. In the same manner, also the temperature sensor 45 for detecting the temperature, is electrically connected to the circuit for the heater by the electric wire, not shown. This temperature sensor 45 is arranged closer to the head chip 41 than the ink heater 49.

In the head drive substrate 46, the connector 461 is provided, and to the connector 461, the input terminal 61 and the output terminal 62 of the flexible wiring plate 60 having the output terminal 62, are respectively connected. Then, to the input to terminal 61 of the flexible wiring plate 60, the power source, not shown, and the control part are electrically connected, and the control signal and the power is supplied to the head drive substrate 46 through this flexible wiring plate 60.

Then, in the inkjet head 4 as shown in FIG. 2, is provided with components of the ink jet head 4 such as the head chip 41, manifold 48, air chamber forming member 58, head drive substrate 46, holding plate 51, and the casing frame 53 in which they are accommodated and fixed, and the cover 54 covering the casing frame 53 are provided. In this casing frame 53, the ink supply path 55 which is connected to the ink supply chamber 52 of the holding plate 51 and supplies the ink is provided, and to this ink supply path 55, the ink supply tubes 6 is connected. Further, inside of the casing frame 53, a support beam 56 supporting the head drive substrate 46 is provided.

In the upper part of the cover 54, an opening 57 is provided, and after the inkjet head 4 is assembled, the input terminal 61 of the flexible wiring plate 60 is exposed to the outside from this opening 57.

Next, the motion at the time of the image formation by the inkjet printer 1, will be described.

When the power source of the inkjet printer 1 is turned ON, the power supply is conducted on each part of the inkjet printer 1.

After that, when the start command of the image recording is inputted, the reciprocal scanning of the carriage 3 is started, and the control part sends the control signal based on the image data to the head drive substrate 46 and the other drive part, and the image recording is started. Onto the recording medium P conveyed by the conveying means, the ink is jetted from the inkjet head 4, and the image is formed.

Then, when the maintenance timing to restore the jetting condition of the inkjet head 4 comes, the control part controls each part and makes the maintenance to the inkjet head 4. When described in detail, the control part controls the motor for scanning following the maintenance timing, and moves the carriage 3 to the position at which the inkjet head 4 opposes to the suction cap 8. When the inkjet head 4 opposes to the suction cap 8, the control part controls the motor for elevation, elevates the maintenance unit 7 up to a position at which the jetting surface 41*a* of the inkjet head 4 close contacts with the suction cap 8.

After the maintenance unit 7 completes the elevation, the control part controls the suction pump 11 so that the inside of the suction cap 8 is sucked for a predetermined time.

Herein, referring to FIG. 5, the moving mode of the ink and the air in the maintenance process by the suction of the inkjet head of the present invention will be described.

By the action of the suction pump 11, the inside of the plurality of ink jetting chambers 44 and the common ink chamber 480 in the inkjet head 4 becomes negative pressure. Also the second ink flow path 581 of the upstream side is negative pressure, and the ink pooled in the air chamber 580 flows from the second ink flow path 581.

In this case, the air 501 in the air chamber 580 swells, and the air liquid interface M of the ink 500 and the air 501 is drawn to the second ink flow path 581 side.

In the inkjet head of the conventional technology, the ink is filled in the common ink chamber in the ordinal use condition, and the air is held, and at the time of the maintenance operation by which the ink is sucked from the nozzle, there is a case where even the air held in the manifold is delivered and substituted with the ink, in such a case, the pressure change can not be absorbed as described above, and there is a possibility that the trouble occurs in the stable setting.

In the inkjet head of the present embodiment, because the second ink flow path 581 branched from the midway of the first ink flow path which guides the ink from the outside to the manifold 48, and connected to the air chamber 580 is provided, the air 501 can he stably held in the air chamber 580 at the time of the maintenance operation by the ink suction motion from the nozzle, the flow-out of the air 501 from the air chamber 580 can be effectively prevented by a simple structure.

Further, in the case where the connection part of the second ink flow path 581 and the air chamber 580 is formed at the position closer to the nozzle 42 side than the ink inlet side of the head chip 41 in the wall surface forming the air chamber 580, when the ink jetting direction is vertically positioned so as to be vertically downward, because the air 501 can be easily held in the upper part of the air chamber 580, the air 501 is easily maintained at the time of suction of the ink from the nozzle in the maintenance process.

Further, in FIG. 5, in the case where the distance between the air liquid interface M before the suction and the upper wall surface of the air chamber is H1, the maximum distance between the air liquid interface M at the time of the suction and the upper wall surface of the air chamber is H2, the distance between the upper end of the connection part of the second ink flow path 581 and the upper wall surface of the air chamber is H3, when the suction pressure or H3 is set so that H2 is smaller than H3, it is preferable because the flow-out prevention of the air 501 of the inside of the air chamber 580 at the time of the suction is assured.

When at the time of the suction., the negative pressure exerting the ink 500 of the air chamber 580, is P1 (air pressure), because the pressure of the air 501 is 1 (air pressure), the relationship of 1/P1=H2/H1 is formed. Accordingly, as a target of the setting, for example, when P1 is 0.5 (air pressure), because H2 is 2 times of H1, H3 may be set so that H3 is larger than this.

For example, it is allowable when the air chamber forming member 58 is structured by the translucent member so that the air liquid interface M inside the air chamber can be visually confirmed, and experimentally, the suction pressure or H3 is set so that H2 is smaller than H3.

Next, the absorption effect of the pressure variation at the time of the image recording, will be described.

Initially, before the recording is conducted by using the inkjet head 4, the following experiment is conducted.

Figure 6:
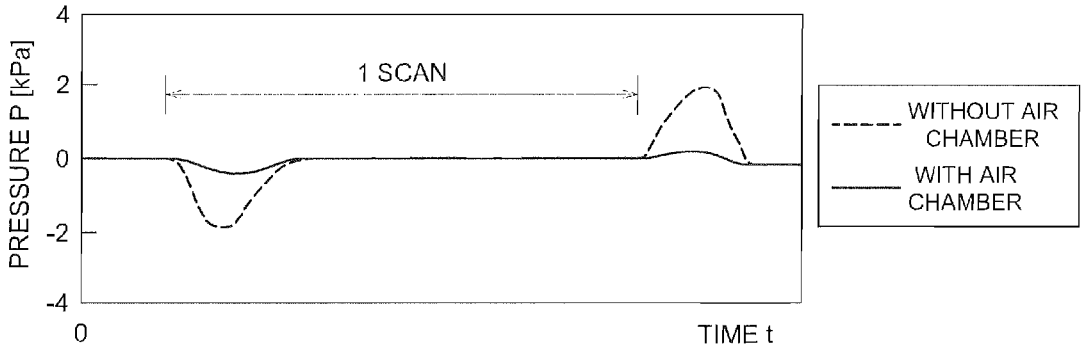
FIG. 6 is a graph showing the pressure variation at a nozzle position at the inkjet head of the present invention and the conventional inkjet head.

When the inkjet head 4 provided with the air chamber 580 by the air chamber forming member 58 shown in FIGS. 2-4, and the inkjet head with only the manifold 48 without the air chamber 580 are equipped in the inkjet printer 1 shown in FIG. 1, and the head is reciprocally moved in the same manner as the practical use condition, and the pressure variation generated in the nozzle part of the head is measured, it is as shown in FIG. 6.

In FIG. 6, the change of the pressure inside the nozzle at the time of scanning, is shown. The horizontal axis is the time, and the vertical axis is the pressure P in the nozzle. Further, the dotted line shows the data measured for the head without the air chamber 580, and the solid line shows the data measured for the head having the air chamber 580.

Ordinarily, the pressure variation is generated by the acceleration at the time of the reciprocal scanning, in the direction of the relationship in which (a) the inkjet head draws the ink supply tube at the time of the reciprocal scanning of the carriage, the negative pressure is generated in the nozzle. Further, (b) in the direction of the relationship in which (a) the inkjet head pushes the ink supply tube at the time of the reciprocal scanning of the carriage, the positive pressure is generated.

When there is no air chamber 580, corresponding to (a), (b), the pressure change of about 2 kPa on the negative pressure side and the positive pressure side is generated, as compared to this, when the air chamber 580 is provided, the pressure change is barely generated and it has the pressure change which is no trouble in the practical use.

Also in the actual image recording, the inkjet head 4 of the present embodiment, can jet stably, and good recording condition can be kept. On the one hand, the inkjet head when it has only the manifold 48 without air chamber 580, can not kept the good recording condition due to the un-stability of the jetting by the pressure variation.

Subsequently, the another embodiment of the present invention will be shown referring to FIG. 7. The present example differs from the above described embodiment, in the following points. The inkjet head 400 of the present embodiment is provided with two (2) row of the nozzle row 42*a*.

Figure 7:
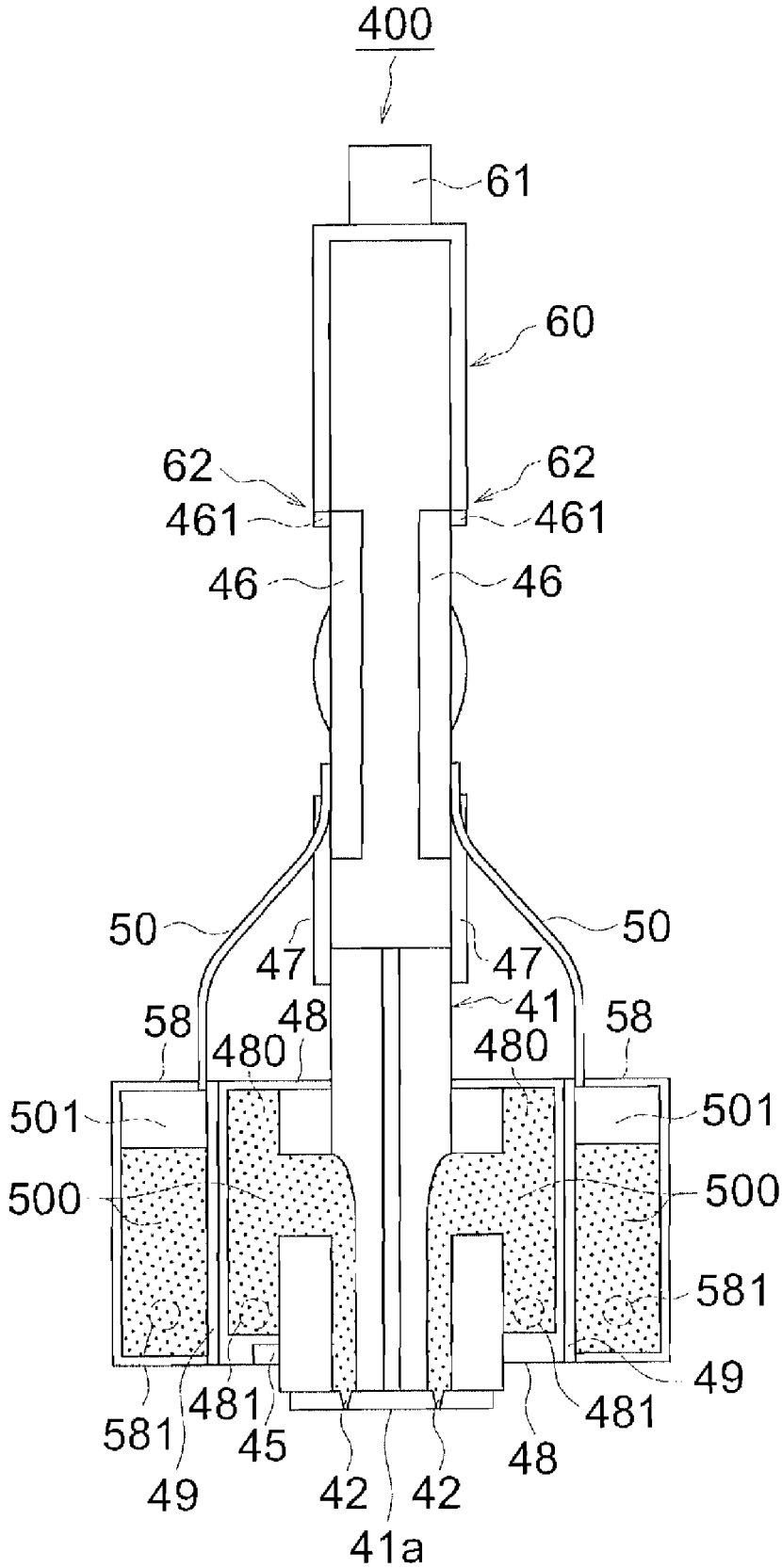
FIG. 7 is a side view of the inkjet head according to an embodiment of the present invention.

As shown in FIG. 7, on both side surfaces of the head chip 41, the ink supply opening 43 is provided, through the ink jetting chambers 44 formed inside the head chip 41, the ink supply opening 43 and the nozzle 42 are continued. It is structured so that one part of the ink jetting chambers 44 forms the pressure chamber, the pressure is varied by the action of the piezo electric element, not shown, and the ink drop is jetted from the nozzle 42.

To both side parts of the ink head chip 41, two (2) manifolds 48 which guide the ink from the outside to the head chip 41 which is connected to the ink supply opening 43, is adhered a/nd fixed. To one end part of the manifold 48, the first ink flow path 481 which flows the ink to the common ink chamber 480 is integrally arranged.

In order to make stable the ink pressure applied to such an inkjet head, two (2) air chamber forming members 58 are arranged on the side parts of two (2) manifolds 48.

The ink from the ink supply tube 6 enters from the ink supply path 55 to the ink supply chamber 52, and branches to the two (2) ink flow paths 481 which connects the ink supply chamber 52 and two (2) manifold 48 and to the two (2) ink flow paths 581 which connects the ink supply chamber 52 and the two (2) air chamber 580. The ink passed the first ink flow path 481 is supplied to the ink jetting chambers from the ink supply opening 43 through the common ink chamber 480. The ink passed the second ink flow path 581, is supplied to the air chamber 580. In the air chamber 580, when the ink 500 is filled from the ink supply path 55, the air 501 is confined. In the practical use condition, as shown in FIG. 7, the ink 500 is filled to a predetermined height of the air chamber 580, and in its upper part, the air 501 is confined.

The air chamber 580 is branched from the first ink flow path which guides the ink from the outside to the manifold 48, by the second ink flow path 581, and the flow-out of the air 501 from the air chamber 580 to the inkjet head chip 41 is suppressed.

The pressure change of the ink generated when the inkjet head 400 is moved, is transmitted from the second ink flow path 581 of the air chamber forming member 58 to the air chamber 580, and absorbed by the volume change of the air 501, and suppressed to a small change of the degree in which the ink pressure in the inkjet head 400 does not influence the jetting characteristic of the ink. In order to more enhance the performance of such a pressure absorption, it is preferable that the resistance of the second ink flow path 581 connecting the ink supply chamber 52 and the air chamber 580, is smaller than the resistance of the first ink flow path 481, connecting the ink supply chamber 52 and the manifold 48. In order to decrease the resistance of the flow path, the sectional area of the flow path may be increased.

Then, each of two (2) head drive substrates 46 which send the control signal from the control part to each piezo electric element, not shown, of the head chip 41, is connected through flexible wiring plate 47. In this head drive substrate 46, the circuit for the heater which conducts the power supply to the ink heater 49 is formed, and to this the circuit for the heater, the electric heating wire of the ink heater 49 is electrically connected through the wire 50. Further, the temperature sensor 45 for detecting the temperature is also in the same manner, electrically connected to the circuit, for the heater by the wire, not shown. This temperature sensor 45 is arranged closer to the head chip 41 than the ink heater 49.

In two (2) head drive substrates 46, respectively connectors 461 are provided, in these connectors 461, the output terminal 62 of the flexible wiring plate 60 having one input terminal 61 and two (2) output terminals 62 are respectively connected. Then, to the input terminal 61 of the flexible wiring plate 60, the power source, not shown, and the control part are electrically connected, and through this flexible wiring plate 60, the control signal and the electric power are supplied to the head drive substrate 46.

As described above, according to the inkjet head of the present embodiment, an inkjet head, by which, because the second ink flow path which is branched from the midway of the first ink flow path by which the ink from the outside is guided to the manifold, and connected to the air chamber, is provided, the air is held when the air liquid interface is formed in the air chamber, and because the pressure variation of the ink transmitted to the manifold at the time of the ink jetting, can be absorbed in the air, and the air can be stably held in the air chamber at the time of the maintenance operation and the variation of the ink supply pressure is absorbed by the air chamber, and the jetting stability can be maintained, and the flow-out of the air from the air chamber can be efffective4ly prevented by a simple structure, can be provided.

Next, referring to FIGS. 8-10, in the air liquid interface in which the air contacts with the ink, the air chamber forming member 58 which replenishes the decrease of the air in which the air dissolves in the ink, will be described in detail.

In the air chamber forming member 58 of the present invention, at least one part which contacts with the air 501 confined in the air chamber 580, of the air chamber forming member 58 has the breathability (air translucency).

In the present embodiment, in the actual use condition, as shown in FIG. 4, when the nozzle 42 is lower side, the ink 500 is filled to a predetermined height of the air chamber 580, and in its upper part, the air 501 is confined. Therefore, in the air chamber forming member 58, a part contacting with the upper surface of the layer-like air 501 is structured by a member having the air translucency. Further, the out side of the member having the air translucency contacts with the air. Further, the air translucency of the member having the air translucency is preferable in a degree of about $5\times10^8$ [$cm^3$] [cm]/[sec][$cm^2$] [cm Hg], and this air permeability is measured by using the air translucency testing method of JIS standard.

The air chamber forming member 58 is a member forming the air chamber 58 between the head chip 41, and is formed of synthetic resin such as acrylic, polyether imide, denatured poly-phenylene ether, poly-carbonate. In them, in the scale accuracy, the translucency, polyether imide is preferable.

Because such a air chamber forming member 58, is die molded by the synthetic resin by using the molding die, it has the thickness more than a predetermined value and does not have the air translucency.

Further, the air chamber forming member 58 is directly adhered to the head chip 41. In the ordinal adhesion, mutual adhered materials to be adhered, are correctly positioned, and tentatively fixed, after the periphery of the air chamber forming member 58 is sealed by the adhesive agent, further, heated and hardened.

In the case where the air chamber forming member 58 and head chip 41 are adhered, because it is extremely difficult to the gap is perfectly eliminated, the air passed the adhesive agent part which fills in the minute gap, is replenished in the air chamber 58. However, because an amount of the air passed such a minute gap is very small, a sufficient replenishment can not be conducted.

Therefore, in the present embodiment, in the air chamber forming member 58, an opening part communicating to the air 501 is provided in a part contacting with the upper surface of the layer-like air 501, and structured in the manner that the opening part is covered by a member having the air translucency.

Figure 8:
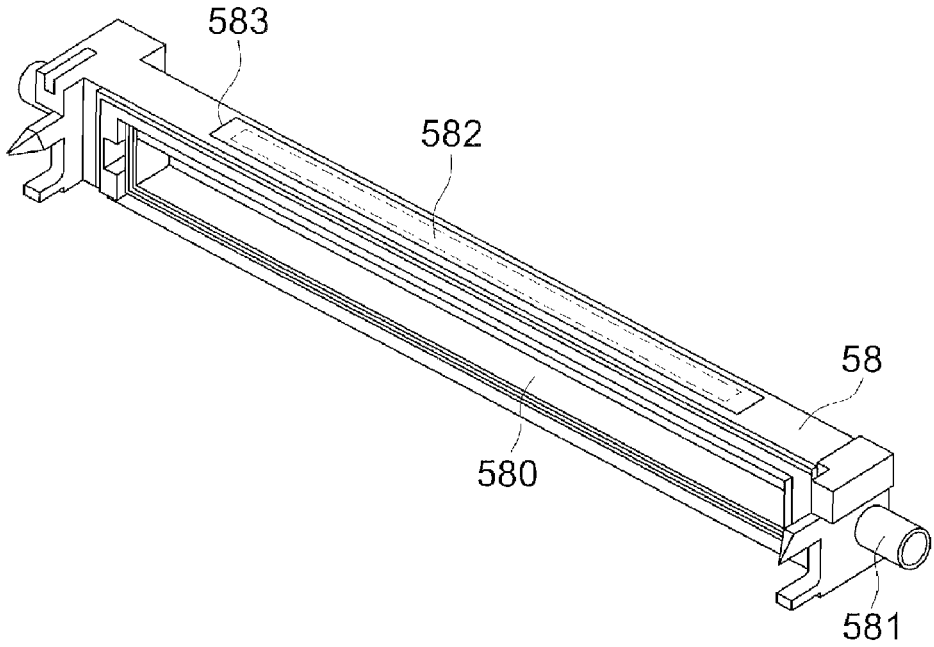
FIG. 8(*a*) is a perspective view of an air chamber forming member according to an embodiment of the present invention.
Figure 8:
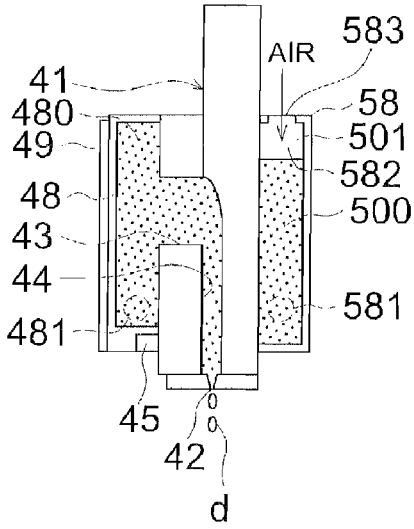

FIGS. 8(*a*) and 8(*b*) illustrate the air chamber forming member 58, FIG. 8(*a*) is a perspective view, FIG. 8(*b*) is a sectional view showing the situation that the air chamber forming member 58 and the manifold 48 are fitted to the head chip 41.

Figure 9:
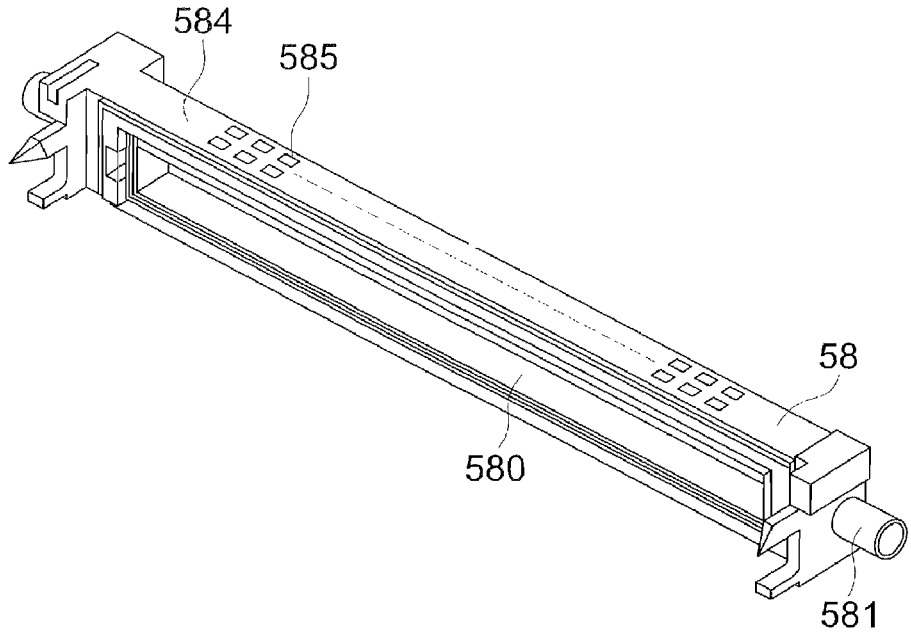
FIG. 9(*a*) is a perspective view of another example of the air chamber forming member according to an embodiment of the present invention.
Figure 9:
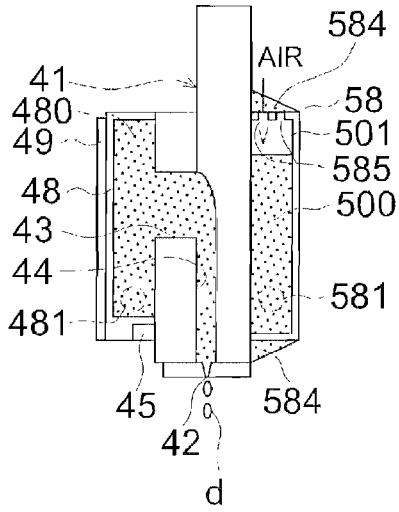

FIGS. 9(*a*) and 9(*b*) illustrate another example of the air chamber forming member 58, FIG. 9(*a*) is a perspective view, FIG. 9(*b*) is a sectional view showing the situation that the air chamber forming member 58 and the manifold 48 are fitted to the head chip 41.

Figure 10:
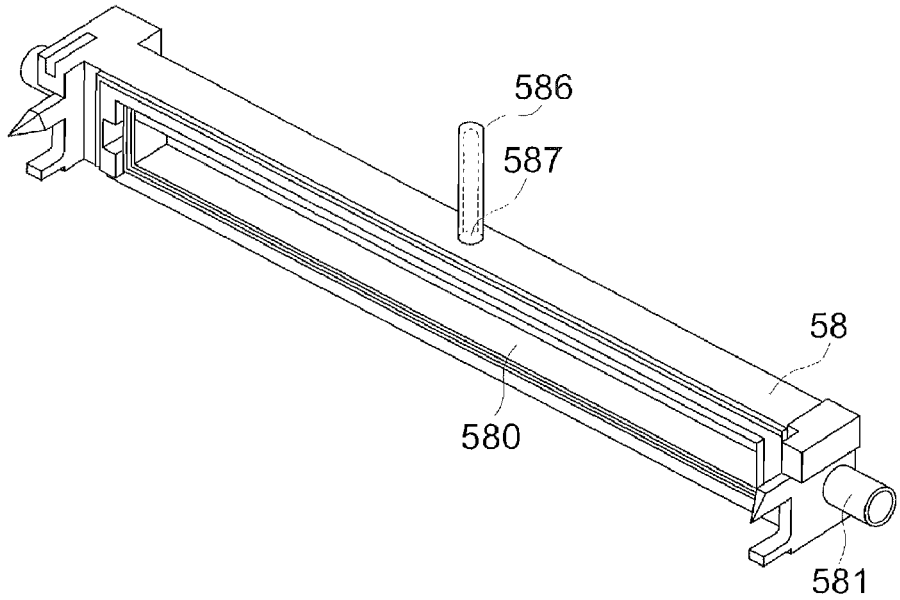
FIG. 10(*a*) is a perspective view of another example of the air chamber forming member according to an embodiment of the present invention.
Figure 10:
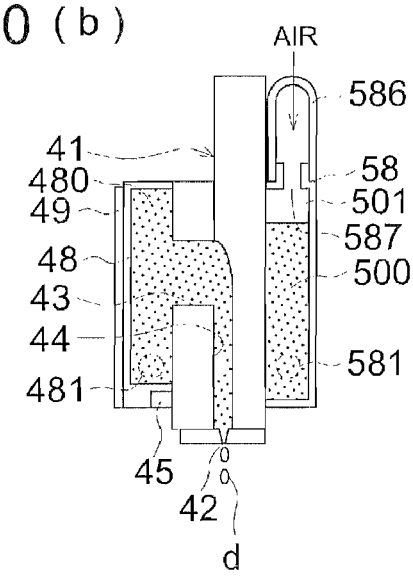

FIGS. 10(*a*) and 10(*b*) illustrates another example of the air chamber forming member 58, FIG. 10(*a*) is a perspective view, FIG. 10(*b*) is a sectional view showing the situation that the air chamber forming member 58 and the manifold 48 are fitted to the head chip 41.

Hereupon, in FIGS. 8(*a*) - 10(*b*), a drive device such as the drive circuit substrate 46 is not shown, however, in practice, as described above, the drive device such as the drive circuit substrate 46 is provided to the head chip 41.

In FIGS. 8(*a*) and 8(*b*), in a part contacting the upper surface of the layer-like air 501, an opening part 582 which is a through-hole, is provided, and is communicated with the inside of the air chamber 580. In the dimension of the opening part 582, its area (when the opening are plural, total area) is about 10 $mm^2$ -30 $mm^2$. The number of the opening part 582 may be formed at least one, however, a plurality of openings may be provided.

Numeral 583 is a film having the air translucency covering the opening part 582, and both of the air chamber forming member 58 and the film 583 are fixedly adhered by a processing method such as heat pressure contact, or supersonic adhesion, or adhesive joining. The air chamber forming member 58 having the opening part 582 is molding processed, by a synthetic resin material as described above. The film 583, considering the air translucency or the ink-proof, is a single layer or multi-layer structure thin film sheet of high polymer resin such as polyethylene or nylon, and in order to obtain the sealing-shape in which there is no ink-leaking when the opening 582 formed in the air chamber forming member 58 is sealed, by the above described processing method, is firmly fixed in the air chamber forming member 58.

The thickness of the film 583 is, considering the air translucency, generally, 0.05 mm-0.2 mm. As the film 583, the half transparent film may be used.

In FIGS. 9(*a*) and 9(*b*), in a part contacting with the upper surface of the layer-like air 501 of the air chamber forming member 58, the mesh-like opening 585 which is through hole is provided, and communicated to the inside of the air chamber 580. Numeral 584 is the adhesive agent for sealing the opening 585.

In the case where the process when the air chamber forming member 58 is adhered to the head chip 41, is described, initially, the air chamber forming member 58 is positioned at a predetermined fitting position of the head chip 41. In this case, because the adhesive agent is not placed between the air chamber forming member 58 and the head chip 41, the positioning of both is easy, can be simply positioned at a predetermined position.

When the positioning of the air chamber forming member 58 is completed, the adhesive agent 584 is applied on the periphery of the air chamber forming member 58 including the opening 585. In the present example, in the mesh-like opening 585, the diameter of the opening 585 of about 100 μm-300 μm is used, however, applied adhesive agent 584 starts gradually the dropping to the opening 585 by the self weight, and tries flowing-out from here, however, by the surface tension, the meniscus forming a predetermined contact angle, is formed. Accordingly, the adhesive agent 584 does not flow out from the opening 585 to the air chamber 580 In this manner, because the adhesive agent 584 forms the film by the surface tension, it has the air translucency and the air chamber of sealing shape can be more simply formed. Herein, for the diameter of the opening 585, when the cross section is circular, it indicates its diameter, when the cross section is not circular, it indicates the diameter (circle corresponding diameter) when the area is substituted with the circle of the same area.

As described above, in the present embodiment, at the same time when the adhesive agent 584 seals the opening 5857 it is the adhesive agent for adhering the air chamber forming member 58 and the head chip 41. When this adhesive agent 584 is provided in the manner that it perfectly surrounds the periphery of the air chamber forming member 58, the function that the periphery of the air chamber forming member 58 is sealed by the adhesive agent, is performed. Hereby, the sealing operation becomes easy.

For such a material, it is necessary that it has the air translucency, and because, locally, it contacts with the ink, the performance which is excellent for the ink-proof, is also required.

As the adhesive agent satisfying such a required characteristic, for example, urethane series adhesive agent, acrylic series adhesive agent, epoxy series adhesive agent, rubber series adhesive agent, or silicon series adhesive agent, can be used. In these materials, the silicon series adhesive agent whose air translucency is high is preferable.

The thickness of the adhesive agent is, considering about the air translucency and the strength, generally, 0.5 mm-3 mm.

Further, for the adhesive agent for sealing the opening 585, and the adhesive agent for adhering the air chamber forming member 58 and the head chip 41, another adhesive agent may also be used. Any one adhesive agent is adhered, and after the adhesive agent is solidified, the other adhesive operation (application of the adhesive agent) is conducted. In this case, it is preferable that the adhesive agent is selected so that the air translucency of the adhesive agent for sealing the opening 585, is larger than the air translucency of the adhesive agent for adhering the air chamber forming member 58 and the head chip 41. The state that the air enters into the ink 500 in the air chamber 58 after passing the adhesive agent adhering the air chamber forming member 58 and the head chip 41, the normal ink jetting is blocked, can be prevented.

In FIGS. 10(*a*) and 10(*b*), in a part contacting with the upper surface of the layer-like air 501 of the air chamber forming member 58, a circular opening 587 which is a through hole, is set up, and communicated to the inside of the air chamber 580. Numeral 586 is tube which is fitted to the opening 587, and has the air translucency and whose one end is closed. The tube 586 is, considering about the air penetrability, or the ink-proof, in the present example, a single layer or multi-layer structured tube formed of the high polymer resin material of such as poly ethylene, or nylon, is adopted, however, it is allowable when the material has the air translucency. The opening 587 has the air translucency, when the tube 586 whose one end is closed is inserted, the air translucent part can be formed more simply.

The thickness of the tube is, considering about the air translucency and the strength, generally, 0.5 mm-2 mm.

In the present embodiment, one opening 587, tube 586 are provided, however, its number is no problem. Further, also its plan shape is particularly no trouble when the tube 586 can be accommodated, it is not limited to the circular shape as shown in the drawing, for example, rectangular, elliptical, and arbitrary.

As described, the inkjet head 4 of the present embodiment, because at least one part which contacts with the air sealed in the air chamber, of the member forming the air chamber has the air translucency, in the air liquid interface in which the air contacts with the ink, the decrease of the air by the phenomenon that the air dissolves into the ink, can be replenished by the air supplied to the air chamber after passing the member having the air translucency, the absorption effect of the pressure variation can be maintained for a long period of time by a simple structure.

Further, when a part contacting with the ink 500 of the air chamber forming member 58 is structured by a member not having the air translucency, it is preferable that the air penetrates into the ink 500 in the air chamber 58, passing the air chamber forming member 58, the situation that normal ink jetting is blocked can be prevented.

Further, the inkjet head 4 of the present embodiment, even when it is left for 3 months, the air 501 of the air chamber 580 is not diminished., and good printing can be conducted.

As described above, because at least one part which contacts with the air sealed in the air chamber, of the member forming the air chamber has the air translucency, in the air liquid interface, in which the air contacts with the ink, the decrease of the air by the phenomenon that the air dissolves into the ink, can be replenished by the air filled in the air chamber after passing the member having the air translucency, the inkjet head by which the absorption effect of the pressure variation can be maintained for a long period of time, can be provided.

Figure 11:
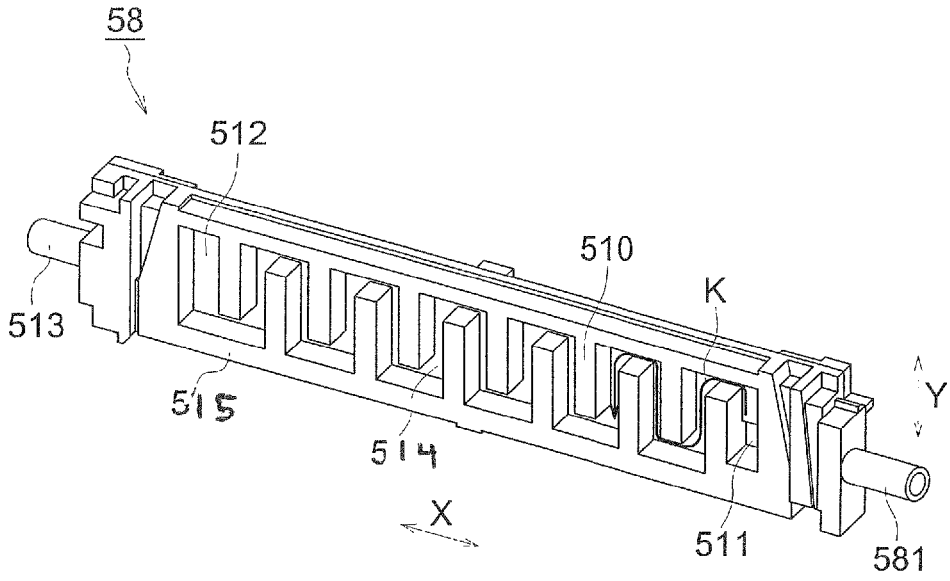
FIG. 11 is a perspective view of an air damper chamber forming member according to an embodiment of the present invention FIG. 12 (*a*) is a typical view showing a condition of an air liquid interface of the air and the ink of the air damper chamber of the inkjet head according to an embodiment of the present invention.

Next, an example in which a labyrinth structure is formed by the air chamber forming member will be described. As shown in FIG. 11, in order to stabilize the ink pressure applied on the inkjet head 4, the air chamber forming member (air damper chamber forming member) 58 is joined (for example, adhesion) to the side surface 41*c* of the head chip of the opposite side of the common ink chamber forming member 48 with the head chip between them. The air chamber forming member 58 is formed of the material excellent for the ink-proof, and the concave part 514 of the labyrinth structure for forming the air chamber 580 of the labyrinth structure (called also meandering structure, and zigzag structure)in which the air 501 exists, is formed.

The air chamber 580 is formed by the box-like air chamber forming member 58 whose opening surface 515 is opened, and the side surface 41*c* of the head chip closing the concave part 514 of the labyrinth structure of the air chamber forming member 58 joined (for example, adhesion) to the opening surface 515 of the air chamber forming member 58, it has the concave part 514 of the labyrinth structure for forming the air chamber 580 of the labyrinth structure.

To the one end part of the air chamber forming member 58, the second ink flow path 581 which flows the ink 500 into the air chamber 580 is integrally provided, and the start end 511 of the concave part 514 of the labyrinth structure is communicated to the second ink flow path 581.

The inside space of the air chamber forming member 58 is sectioned by a plurality of partitions 510 having the function as the inner wall surface structural part, and in the inside space, the concave part 514 of the labyrinth structure which is communicated to the second ink flow path 581, is formed.

The above-described partition wall 510 is, its one side end part is integrally joined to the bottom surface of the air chamber forming member 58, the end edge part of the upper and lower both sides are respectively integrally joined to the upper and lower side surfaces of the air chamber forming member 58, and the start end 511 of the concave part 582 of the labyrinth structure communicated to the second ink flow path 581, is provided on the lower side part of right side end edge part. Hereupon, the other side edge part of the above-described partition wall 510 is joined to the side surface 41*c* of the head chip when the air chamber forming member 58 is joined to the head chip.

In the air chamber 580 of the above-described labyrinth structure, the leader 511 is communicated to the second ink flow path 581, and the other end part 512 is closed, when a plurality of the partitions 510 are in the upper and lower direction Y, and one end is alternatively separated from the air chamber forming member 580 and are vertically provided, the direction K of the labyrinth from the leader 511 to the other end part 512 has the zigzag structure which is formed zigzag-like.

When the inkjet head 4 is used, the air chamber 580 of the labyrinth structure, is arranged so that the surface including the above-described zigzag structure is non-parallel to the horizontal surface. In the present embodiment, the surface including the zigzag structure is arranged so that it conforms to the XY plane.

Further, the inkjet head 4 has the air filling mechanism. The air filling mechanism is a mechanism for filling the air to the other and side 512 which differs from the leader 511 of the communication side to the ink supply path in the air chamber 580. The air filling mechanism is closed at the ordinary time, and is structured so that it is opened when the air in the air chamber 580 is lost. In the present embodiment, as shown in FIG. 4, the by-pass 513 communicating to the other end side 512 is covered by the sealing means (not shown) such as the valve or plug, and the situation that the injector is inserted into this part and the air can be filled, is formed.

As described above, in the present embodiment, because the air chamber 580 is the complicate labyrinth structure, coupled with that the flow path is slenderized, by a simple structure, the free movement of the air 501 in the air chamber 580, is regulated, and the flow-out of the air 501 can be suppressed. When the flow path is slenderized, because the sectional area of the flow path can be decreased predetermined air volume is held in the air chamber 580, and the contact surface in the air liquid interface in which the air contacts with the ink can be decreased, and by the phenomenon that the decreasing speed of the air by the phenomenon that the air dissolves into the ink becomes slow, the dissolution of the air can be suppressed by a simple structure.

Hereupon, when the inside wall surface of at least one part of the air chamber 580 of the labyrinth structure is formed by the partition wall 510 arranged so that the labyrinth structure is formed, the air chamber 580 of the labyrinth structure can be formed simply.

Further, when the labyrinth structure of the air chamber 580 has the zigzag structure, the flow-out or the dissolution of the air can be more effectively suppressed.

Further, when from the communication side 511 to the ink supply path in the air chamber 580 of the labyrinth structure to the other end side 512, the zigzag structure is formed, the flow-out or the dissolution of the air can be more effectively suppressed.

Further, in the case where, when the inkjet head is used, the air chamber 580 of the labyrinth structure is arranged so that the surface including the zigzag structure is inclined from the horizontal surface, the flow-out or the dissolution of the air can be more effectively suppressed.

Further, when the surface of one part of the head chip forms one part of the inside wall surface of the air chamber, the down-sizing of the inkjet head becomes possible, and the vibration of the piezo electric element of the head chip when the ink is jetted, can be absorbed in the liquid (ink 500) in the air chamber, and it can be suppressed that the vibration is transmitted to the outside.

Further, when the air chamber 580 of the labyrinth structure is structured as described above, because the partition wall 510 structuring the inside wall surface of the air chamber 580 of the labyrinth structure is integrally formed in the air chamber forming member 58, and the concave part of the labyrinth structure is formed in the manner that it is opened to one direction, the air chamber forming member 58 can be easily molded by the resin material by the metallic die, together with the concave part of the labyrinth structure.

Further, in the case where, when the head chip is joined to the air chamber forming member 58, the leading edge part of the partition wall 510 is only joined to the side surface of the head chip, the air chamber 580 of the labyrinth structure can be simply formed.

Further, when the air filling mechanism which fills the air to the other end side different from the communication side to the ink supply path in the air chamber, is provided, even when the air in the air chamber is lost, the air is easily filled.

Figure 12:
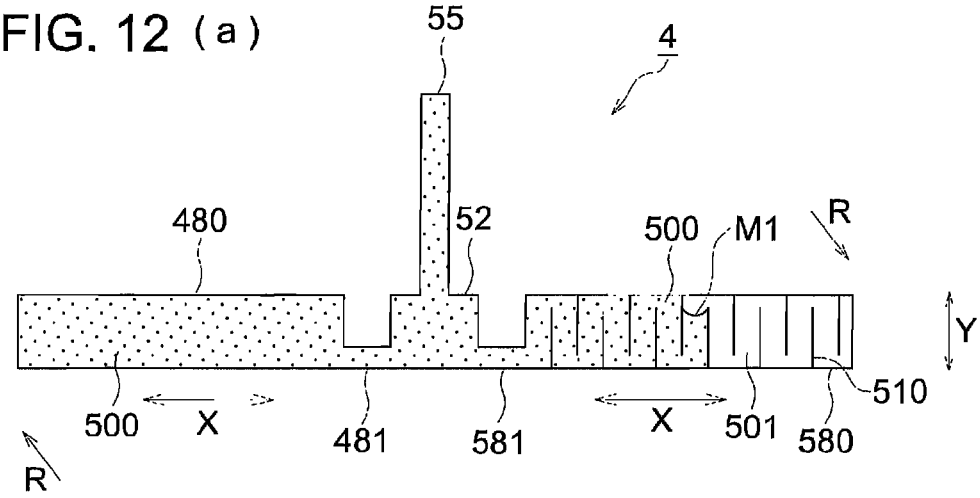
FIG. 12(*b*) is a typical view showing a condition of an air liquid interface of the air and the ink of the air damper chamber of the inkjet head according to a reference example.
Figure 12:
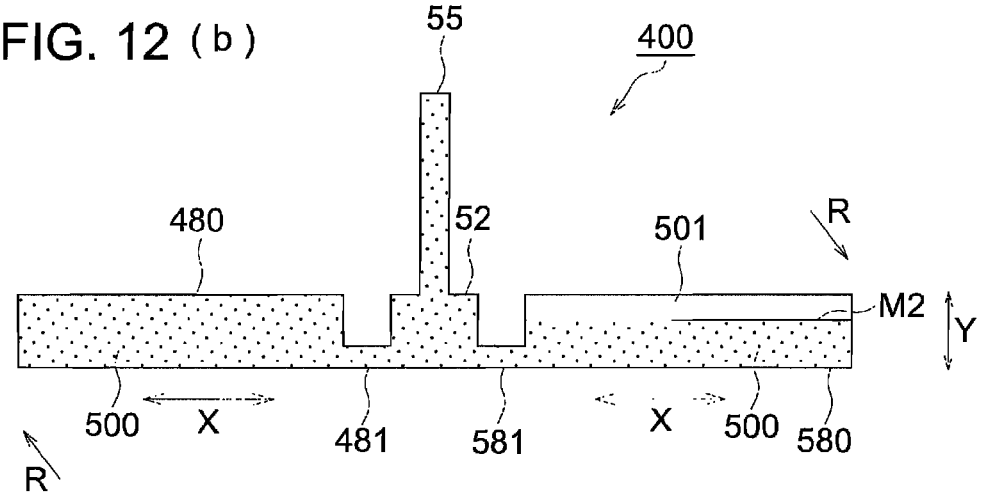

Next, referring to FIGS. 12(*a*) and 12(*b*), the action of the air chamber 580 of the present embodiment, will be described in detail. FIG. 12(*a*) is a typical view showing the situation of the air liquid interface M1 of the air 501 of the air chamber 580 of the inkjet head 4 according to the present embodiment and the ink 500. FIG. 12(*b*) is a typical view showing the situation of the air liquid interface M2 of the air 501 of the air chamber 580 when the partition wall 510 of the inkjet head 400 according to the reference example is not provided, and the ink 500. It is assumed that In FIG. 12(*a*) and FIG. 12(*b*), the same volume air 501 exists.

Hereupon, FIGS. 12(*a*) and 12(*b*) show the connection situation of the air chamber 580 of the inkjet head and the common ink chamber 480 to the ink supply chamber 52.

As shown in FIG. 12(*a*), the ink from the ink supply tube 6 enters fr4om the ink supply path 55 to the ink supply chamber 52, and branches to the first ink flow path 481 connecting the ink supply chamber 52 and the common ink chamber 480, and to the second ink flow path 581 connecting the ink supply chamber 52 and the air chamber 580. The ink passed the first ink flow path 481 is supplied to the head chip 41 from the ink supply opening 43 after passing the common ink chamber 480. The ink passed the second ink flow path 581l is supplied to the air chamber 580. When the ink 500 is filled from the ink supply path 55, the air 501 is sealed in the air chamber 580 which is communicated to the connection part to the second ink flow path 581, of the labyrinth structure formed by a plurality of partition walls 510. When it is used, the ink 500 is filled to a predetermined part of the air chamber 580 of the labyrinth structure, the air 501 is sealed in its remained part, and the air liquid interface Ml of the small contact surface regulated by the partition wall 510 is formed.

On the one hand, when the partition wall 510 is not formed, as shown in FIG. 12(*b*), the ink passed the second ink flow path 581 is supplied to the air chamber 580. When the ink 500 is filled from the ink supply path 55, the air 501 is sealed in the air chamber 580 communicated to the connection part to the second ink flow path 581. At the time of use, as shown in FIG. 12(*b*), when the nozzle 42 faces downside, the ink 500 is filled to a predetermined height of the air chamber 580, in its upper part, the air 501 is sealed, and the air liquid interface M2 having the large contact area is formed.

In the present embodiment, when the complicated labyrinth structure is formed by the partition wall 510, when the flow path is slenderized, because the sectional area of the flow path can be smaller than the case where the partition wall is not arranged, a predetermined air volume is held in the air chamber, the contact area in the air liquid interface in which the air contacts with the ink can be decreased, and, when the speed of the decrease of the air becomes slow because the air dissolves in the ink, the dissolution of the air can be suppressed by a simple structure. Accordingly, the inkjet head by which the variation of the supply pressure of the ink is absorbed, and the jetting stability can be maintained can be obtained.

Further, in the present embodiment, because the air chamber 580 is formed in the complicate labyrinth structure, combined with the case where the flow path is slenderized, the free movement of the air 501 in the air chamber 580 is regulated, and the flow-out of the air 501 can be suppressed by a simple structure.

For example, in the structure of FIG. 12(*b*), when the inkjet head is inclined in the direction of the arrow mark R, or when the air liquid interface is vibrated by the outside vibration, the flow-out of the air 501 from the air chamber 580 to the second ink flow path 581, is easily occurred, however, in the structure of FIG. 12(*a*), because it has the partition wall 510, and there is a complicated labyrinth structure, even when the inclination or the outside vibration is generated, because the air can be stably held in the air chamber, the flow-out of the air from the air chamber can be suppressed by a simple structure.

Herein, the meniscus holding force of the air liquid interface, is proportional to the surface tension of the ink, and inverse proportion to the diameter of the air liquid interface (corresponding to the contact area). In the present embodiment, when the contact area is decreased, because the meniscus holding force can be increased, the air liquid interface hardly moves to the vibration or inclination, and the strong structure can be obtained.

The pressure change of the ink generated when the inkjet head 4 moves is transmitted from the second ink flow path 581 to the air chamber 580, absorbed by the volume change of the air 501, and is suppressed to the small change of the degree in which the ink pressure in the inkjet head 4 does not influence on the jetting characteristic of the ink. In order to more increase the performance of such a pressure absorption, it is preferable that the resistance of the second ink flow path 581 communicating the ink supply chamber 52 and the air chamber 580, is smaller than the resistance of the first ink flow path 481 communicating the ink supply chamber 52 and the common ink chamber 480, and in order to decrease the resistance of the flow path, the sectional area of the flow path may be increased.

Hereupon, for the maintenance timing for recovering the jetting condition of the inkjet head 4, by the operation of the suction pump 11, the inside of the ink jet head 4 is negative pressure. The second ink flow path 581 of the upstream side of the air chamber 580, is also negative pressure, the ink stored in the air chamber 580 flows from the second ink flow path 581.

In this case, the air 501 in the air chamber 580 shown in FIGS. 12(*a*) and 12(*b*) swells, and the air liquid interface M1 and M2 of the ink 500 and the air 501 is attracted to the second ink flow path 581 side.

For example, in the structure of FIG. 12(*b*), when the air liquid interface M2 is moved to lower side by the suction from this condition, and arrives at the position of the second ink flow path 581, although the flow-out of the air 501 from the air chamber 580 to the second ink flow path 581 is generated, the volume of the air 501 just before the flow-out is generated is V1.

On the one hand, in the structure of FIG. 12(*a*), because it has the partition wall 510, the air liquid interface M1 moves windling in the air chamber 580 of the labyrinth structure, when arrives at the position of the second ink flow path 581, the flow-out of the air 501 from the air chamber 580 to the second ink flow path 581 is generated, and the volume of the air 501 just before the flow-out is generated is V2.

Herein, as can clearly be seen from the view, V1<V2. Accordingly, in the structure of FIG. 12(*a*) of the present embodiment, even when in FIG. 12(*b*), the suction is conducted by the same pressure as the pressure by which the flow-out of the air 501 is generated, the flow-out of the air 501 is not generated, and because even at the time of suction, the air can be more stably held in the air chamber, the flow-out of the air from the air chamber can be suppressed by s simple structure.

As described above, according to the inkjet head 4 of the present embodiment, because the nozzle jetting the ink and the inkjet head chip having the pressure chamber communicating to the nozzle, the ink supply path for supplying the ink from the outside to the inkjet head chip, and labyrinth structured air chamber branched from the ink supply path are provided, the flow-out of the air from the air chamber, or dissolution can be suppressed by a simple structure, the inkjet head by which the variation of the supply pressure of the ink can be absorbed, and the jetting stability can be maintained, can be obtained.

Hereupon, as the inkjet head and the inkjet printer according to the present invention, it is not limited to the above described embodiment, but also to the device of another structure, it can be applied.

The inkjet head of the present invention can not only apply to the inkjet printer of so-called serial print type in which the above described head moves, but also apply to the inkjet printer of the line print type, it is effective.

Further, the inkjet head is not limited to the structure providing with the piezo electric element, but may be the structure providing with, for example, a heater.

Further, the shape or positional relationship of the manifold or the air chamber can also be conducted being appropriately changed.

For example, in another embodiment of FIG. 7, in the inkjet head 400 having two (2) manifolds 48, the structure in which the air chambers 580 are respectively provided on the side part of two (2) manifolds is exemplified, and described, however, the air chamber 580 may be not two (2), and it may be allowable even when one air chamber 580 is provided to any manifold 48.

Further, in the embodiment of FIG. 2, it may be allowable even when the air chamber 580 is provided to the side part of the manifold 48.

What is claimed is:

1. An inkjet head for jetting ink while moving, comprising:

an ink jetting chamber unit in which a plurality of ink jetting chambers to jet ink from respective nozzles is arranged along at least one array;

a manifold to distribute ink to the plurality of ink jetting chambers;

a first ink flow path to supply ink from the outside of the inkjet head to the manifold;

an air chamber structured so as to form an air-liquid interface at which air contacts with ink in the air chamber; and a second ink flow path made to branch from the first ink flow path, one end of the second ink flow path connected to the first ink flow path and the other end of the second ink flow path connected to the air chamber.

2. The inkjet head of claim 1, wherein the manifold is provided at one side of the ink jetting chamber unit and the air chamber is provided at the other side of the ink jetting chamber unit.

3. The inkjet head of claim 2, wherein the ink jetting chamber unit has a side wall forming a part of the side wall of the air chamber.

4. The inkjet head of claim 1, wherein the ink jetting chamber unit includes two arrays of the plurality of ink jetting chambers, the manifold includes a first manifold provided at one side of the ink jetting chamber unit and a second manifold provided at the other side of the ink jetting chamber unit, and the air chamber includes a first air chamber provided at a side of the first manifold and a second air chamber provided at a side of the second manifold.

5. The inkjet head of claim 1, wherein the first ink flow path is provided with an ink supply chamber and the second flow path is branched from the ink supply chamber.

6. The inkjet head of claim 1, wherein the ink jetting chamber unit has an ink inlet side and a nozzle side, and a connection part of the second ink flow path with the air chamber is formed on a position closer to the nozzle side than the ink inlet side of the ink jetting chamber unit on a wall surface forming the air chamber.

7. The inkjet head of claim 1, wherein the flow resistance of the second ink flow path is smaller than that of the first ink flow path located between the manifold and the one end of the second flow path.

8. The inkjet head of claim 1, wherein a part of a member forming the air chamber and coming in contact with air kept in the air chamber has an air permeability.

9. The inkjet head of claim 8, wherein the member having the air permeability is a film having a air permeability.

10. The inkjet head of claim 8, wherein the member having a air permeability is an adhesive having an air permeability and sealing a mesh-like opening provided to the member forming the air chamber.

11. The inkjet head of claim 8, wherein the member having the air permeability is a tube having an air permeability and attached to an opening provided to the member forming the air chamber.

12. The inkjet head of claim 8, wherein the outside of the member having the air permeability comes in contact with atmosphere.

13. The inkjet head of claim 1, wherein the air chamber has a labyrinth structure.

14. The inkjet head of claim 13, wherein at least a part of an inner wall of the air chamber of the labyrinth structure is formed by a partition wall arranged to form the labyrinth structure.

15. The inkjet head of claim 13, wherein the labyrinth structure is a zigzag structure.

16. The inkjet head of claim 15, wherein the zigzag structure is shaped in a form of a bar, one end of the zigzag structure is connected to the second ink flow path and the air chamber is formed in the vicinity of the other end of the zigzag structure.

17. The inkjet head of claim 15, wherein the air damper chamber of the labyrinth structure is arranged such that a plane including the zigzag structure is not in parallel to the horizontal plane.

18. The inkjet head of claim 15, wherein the air chamber is provided with an air injecting mechanism.

19. An inkjet recording apparatus, comprising:

the inkjet head described in claim 1;

an ink supply tank to supply ink to the inkjet head; and a conveying section to convey the inkjet head so as to record an image on a recording sheet.

20. The inkjet recording apparatus of claim 19, further comprising:

a pipe to supply ink from the tank to the inkjet head.

21. The inkjet head of claim 1, further comprising:

a casing in which the ink jetting chamber unit, the manifold, and the air chamber are incorporated so as to form one body.

22. The inkjet head of claim 21, wherein the manifold adjoins one side of the ink jetting chamber unit and the air chamber adjoins another side of the ink jetting chamber unit.

23. The inkjet head of claim 21, wherein the casing has an ink inlet port, the first ink flow path is arranged in the casing so as to connect the ink inlet port to the manifold, and the second ink flow path is arranged in the casing so as to branch from the first ink flow path and connected to the air chamber.

24. The inkjet head of claim 21, wherein the respective nozzles of the plurality of ink jetting chambers are positioned at the lower side of the casing and the air-liquid interface in the air chamber is positioned above the respective nozzles.

* * * * *